US011164526B2

(12) United States Patent
Kim et al.

(10) Patent No.: US 11,164,526 B2
(45) Date of Patent: Nov. 2, 2021

(54) METHOD OF AGING TRANSISTOR AND DISPLAY DEVICE INCLUDING THE TRANSISTOR

(71) Applicant: Samsung Display Co., LTD., Yongin-si (KR)

(72) Inventors: Keun Woo Kim, Yongin-si (KR); Mee Jae Kang, Yongin-si (KR); Han Bit Kim, Yongin-si (KR); Thanh Tien Nguyen, Yongin-si (KR); Yong Su Lee, Yongin-si (KR); Jae Seob Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/811,514

(22) Filed: Mar. 6, 2020

(65) Prior Publication Data

US 2020/0342815 A1 Oct. 29, 2020

(30) Foreign Application Priority Data

Apr. 23, 2019 (KR) ..... 10-2019-0047416

(51) Int. Cl.
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2320/0214* (2013.01); *G09G 2320/043* (2013.01)

(58) Field of Classification Search
USPC ..... 257/369, 402, E21.409, E27.062, 257/E29.242; 438/286
See application file for complete search history.

(56) References Cited

U.S. PATENT DOCUMENTS

2018/0158406 A1 6/2018 Kim et al.
2019/0043997 A1 2/2019 Lee
2020/0135091 A1* 4/2020 Kim ..... G09G 3/3233

FOREIGN PATENT DOCUMENTS

JP 2011-112722 6/2011
KR 10-2018-0072041 6/2018
KR 10-2019-0014991 2/2019

OTHER PUBLICATIONS

Keunwoo Kim et al., "Double-Gate CMOS: Symmetrical- Versus Asymmetrical-Gate Devices", Feb. 2001, pp. 294-299, vol. 48, No. 2, IEEE Transactions on Electron Devices.

(Continued)

*Primary Examiner* — Deeprose Subedi
(74) *Attorney, Agent, or Firm* — Kile Park Reed & Houtteman PLLC

(57) ABSTRACT

A display device including pixels is provided. Each of the pixels includes a first transistor having a gate electrode connected to a first node, a first electrode connected to a second node, and a second electrode connected to a third node, a second transistor having a gate electrode connected to a first scan line, a first electrode connected to a data line, and a second electrode connected to the second node, and a third transistor having a first gate electrode connected to the first scan line, a second gate electrode, a first electrode connected to the first node, and a second electrode connected to the third node. The second gate electrode may be in a floating state, and the third transistor may be aged to alleviate a leakage current in order to improve image generation.

25 Claims, 15 Drawing Sheets

(56) References Cited

OTHER PUBLICATIONS

Keunwoo Kim et al., "Low-Power High-Performance Asymmetrical Double-Gate Circuits Using Back-Gate-Controlled Wide-Tunable-Range Diode Voltage", Sep. 2007, pp. 2263-2268, vol. 54, No. 9, IEEE Transactions on Electron Devices.
Song-Geun Park et al., "Suppression of Leakage Current in Solid-Phase Crystallization Silicon Thin-Film Transistors Employing Off-State-Bias Annealing", 2009, vol. 48, Japanese Journal of Applied Physics.

* cited by examiner

METHOD OF AGING TRANSISTOR AND DISPLAY DEVICE INCLUDING THE TRANSISTOR

CROSS-REFERENCE TO RELATED APPLICATION

This application claims priority to Korean Patent Application No. 10-2019-0047416 under 35 U.S.C. § 119, filed in the Korean Intellectual Property Office on Apr. 23, 2019, the entire contents of which are herein incorporated by reference.

BACKGROUND

1. Field

The disclosure relates to a method of aging a transistor and a display device including the transistor, and more specifically to aging such a transistor to prevent or alleviate a leakage current when the transistor is in an off state.

2. Description of the Related Art

As an information technology is developed, importance of a display device, which is a connection medium between a user and information, is emphasized. In response to this, Usage of display devices such as a liquid crystal display device, an organic light emitting display device, and a plasma display device has been increasing as individual users require such devices to both maintain livelihood and pursue recreational and other informational goals.

When in use, a particular display device may be driven according to various driving frequencies. For example, when the display device is driven at a drive frequency of 60 Hz, the display device may display 60 image frames per second. In contrast, when the display device is driven at a drive frequency of 30 Hz, the display device may display 30 image frames per second.

When the display device is driven at a low frequency, each pixel is required to maintain information on each image frame for a relatively long period of time. As a result, a leakage current may occur in each pixel, such that the information on the image frame may not be maintained. Accordingly, deterioration or a flicker of the image may occur.

SUMMARY

Embodiments herein provide a method of aging a transistor and a display device including the transistor that prevents or alleviates a leakage current when the transistor is in an off state. As a result, momentary afterimage often resulting from the leakage current may likewise be prevented or alleviated.

A display device according to an embodiment may include pixels. Each of the pixels may include a first transistor having a gate electrode connected to a first node, a first electrode connected to a second node, and a second electrode connected to a third node, a second transistor having a gate electrode connected to a first scan line, a first electrode connected to a data line, and a second electrode connected to the second node, and a third transistor having a first gate electrode connected to the first scan line, a second gate electrode, a first electrode connected to the first node, and a second electrode connected to the third node.

The second gate electrode may be in a floating state.

The third transistor may include a semiconductor layer disposed between the first gate electrode and the second gate electrode, and the semiconductor layer may include a source region, a channel region, and a drain region.

The second gate electrode may be disposed to overlap at least a part of at least one of the source region, the channel region, and the drain region.

The third transistor may further include a gate insulating layer disposed between the first gate electrode and the semiconductor layer, wherein the gate insulating layer has a first region adjacent to the drain region and a second region adjacent to the source region, wherein an electron or hole density in the first region is higher than an electron or hole density in the second region.

The second gate electrode may be disposed to overlap a portion of the semiconductor layer other than the source region.

The first electrode of the third transistor may be connected to the drain region, and the second electrode of the third transistor may be connected to the source region.

The first electrode of the third transistor may be connected to the source region, and the second electrode of the third transistor may be connected to the drain region.

The third transistor may further include a gate insulating layer disposed between the first gate electrode and the semiconductor layer, and wherein the gate insulating layer has a first region adjacent to the drain region and a second region adjacent to the source region, wherein an electron or hole density in the first region is higher than an electron or hole density in the second region.

The third transistor may include a first sub-transistor having a sub-gate electrode connected to the first scan line, a first electrode connected to the first node, and a second electrode, and a second sub-transistor having a sub-gate electrode connected to the first scan line, a first electrode connected to the second electrode of the first sub-transistor, and a second electrode connected to the third node.

The sub-gate electrode of the first sub-transistor may be separate from the first electrode and the second electrode of the first sub-transistor, and the sub-gate electrode of the second sub-transistor may be separate from the first electrode and the second electrode of the second sub-transistor.

One of the first sub-transistor and the second sub-transistor may include the second gate electrode. The first sub-transistor may include a semiconductor layer positioned between the sub-gate electrode and the second gate electrode, the semiconductor layer may include a source region, a channel region, and a drain region, the second gate electrode may be disposed to overlap at least a part of at least one of the source region, the channel region, and the drain region, and the first sub-transistor may further include a gate insulating layer disposed between the sub-gate electrode and the semiconductor layer, wherein the gate insulating layer may include a first region adjacent to the drain region and a second region adjacent to the source region, and wherein an electron or hole density in the first region is higher than an electron or hole density in the second region.

The second gate electrode may be disposed to overlap at least a part of the semiconductor layer other than the source region.

At least one of the first sub-transistor and the second sub-transistor may include the second gate electrode.

The second gate electrode may be disposed to overlap at least a part of at least one of the source region, the channel region, and the drain region, and the second sub-transistor may further include a gate insulating layer between the sub-gate electrode and the semiconductor layer, wherein the gate insulating layer has a first region adjacent to the drain region and a second region adjacent to the source region, and wherein an electron or hole density in the first region may be higher than an electron or hole density in the second region.

The second gate electrode may be disposed to overlap a part of at least one of the drain region, and the second gate electrode may not overlap the source region.

The first sub-transistor and the second sub-transistor may include the second gate electrode.

Each of the pixels may further include a light emitting diode, and the second gate electrode may be connected to a cathode of the light emitting diode.

A method of aging a transistor, which includes a first gate electrode, a second gate electrode, and a semiconductor layer disposed between the first gate electrode and the second gate electrode, and including a source region doped with an acceptor, a channel region, and a drain region doped with an acceptor, according to an embodiment, includes applying a voltage higher than a voltage of the drain region to the first gate electrode, and applying a voltage lower than the voltage of the first gate electrode to the second gate electrode.

The second gate electrode may be disposed to overlap at least a part of at least one of the source region, the channel region, and the drain region.

The second gate electrode may be disposed to overlap at least a part of at least one of the drain region, and the channel region.

A method of aging a transistor, which includes a first gate electrode, a second gate electrode, and a semiconductor layer disposed between the first gate electrode and the second gate electrode, and including a source region doped with a donor, a channel region, and a drain region doped with a donor, according to an embodiment, includes applying a voltage lower than a voltage of the drain region to the first gate electrode; and applying a voltage higher than the voltage of the first gate electrode to the second gate electrode.

The second gate electrode may be disposed to overlap at least a part of at least one of the source region, the channel region, and the drain region.

The second gate electrode may be disposed to overlap at least a part of at least one of the drain region and the channel region.

The method of aging the transistor and the display device including the transistor herein may alleviate a leakage current when the transistor is in an off state.

The method of aging the transistor and the display device including the transistor herein may alleviate a momentary afterimage.

BRIEF DESCRIPTION OF THE DRAWINGS

The above and other features of the invention will become more apparent by describing in further detail embodiments thereof with reference to the accompanying drawings, in which.

DETAILED DESCRIPTION OF THE EMBODIMENTS

Figure 1:
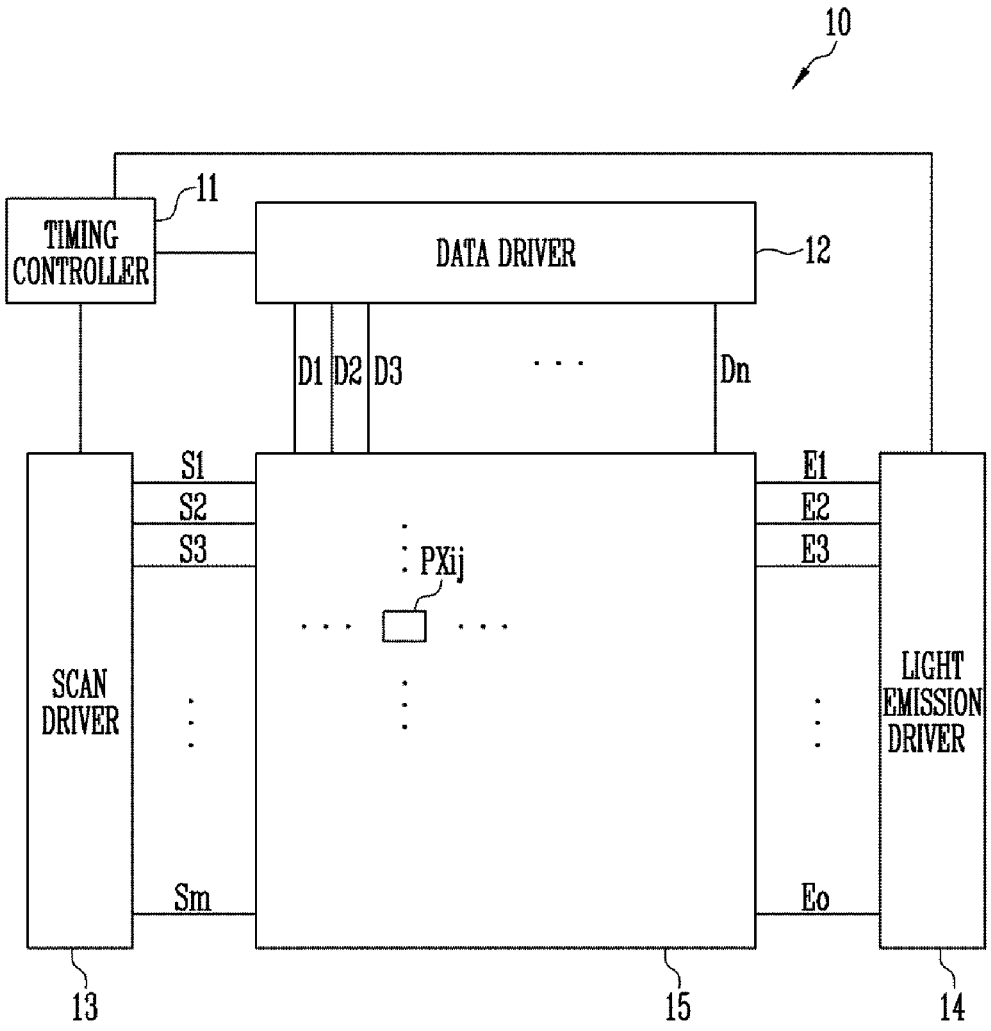
FIG. 1 shows a display device configuration according to an embodiment of the disclosure.

Hereinafter, various embodiments of the invention will be described in detail with reference to the accompanying drawings. The invention may be embodied in many different forms and is not limited to the embodiments described herein.

In order to clearly illustrate the invention, parts not related to the description are omitted, and the same or similar components are denoted by the same reference numerals throughout.

Sizes and thicknesses of the respective components shown in the drawings are arbitrarily shown for convenience of description as the invention is not necessarily limited to those shown in the drawings.

In the specification, the term "and/or" includes any and all combinations of one or more of the associated listed items. Expressions such as "at least one of," when preceding a list of elements, modify the entire list of elements and do not modify the individual elements of the list. As used herein, the singular forms "a," "an" and "the" are intended to include the plural forms as well, unless the context clearly indicates otherwise.

Throughout the specification, when an element is referred to as being "connected" to another element, the element may be "directly connected" to another element, or "electrically connected" to another element with one or more intervening elements interposed therebetween. It will be further understood that when the terms "comprises," "comprising," "includes" and/or "including" are used in this specification, they or it may specify the presence of stated features, integers, steps, operations, elements and/or components, but do not preclude the presence or addition of other features, integers, steps, operations, elements, components, and/or any combination thereof.

The terms "overlap" or "overlapped" means that a first object may be above or below a second object, and vice versa.

It will be understood that, although the terms "first," "second," "third," or the like may be used herein to describe various elements, these elements should not be limited by these terms. These terms are used to distinguish one element from another element or for the convenience of description and explanation thereof. For example, when "a first element" is discussed in the description, it may be termed "a second element" or "a third element," and "a second element" and "a third element" may be termed in a similar manner without departing from the teachings herein.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the specification.

FIG. 1 is a diagram showing a display device configuration according to an embodiment of the disclosure.

Referring to FIG. 1, the display device 10 according to an embodiment of the disclosure may include a timing controller 11, a data driver 12, a scan driver 13, a light emission driver 14, and a pixel unit 15.

The timing controller 11 may receive grayscale values and control signals for each frame from an external processor. The timing controller 11 may render the grayscale values so that the grayscale values correspond to a specification of the display device 10. For example, the external processor may provide a red grayscale value, a green grayscale value, and a blue grayscale value for each unit dot. However, when the pixel unit 15 is a pentile structure, since adjacent unit dots share pixels, the pixels may not correspond to the respective grayscale values on a one-to-one basis. Thus, rendering of the grayscale values is necessary. When the pixels correspond to the respective grayscale values on a one-to-one basis, rendering of the grayscale values may be unnecessary. The grayscale values that are not rendered or rendered may be provided to the data driver 12. In addition, the timing controller 11 may provide control signals suitable for each of the data driver 12, the scan driver 13, the light emission driver 14, and the like, to the data driver 12, the scan driver 13, the light emission driver 14, and the like for frame display.

The data driver 12 may generate data voltages to be provided to data lines D1, D2, D3, and Dn using the grayscale values and the control signals. For example, the data driver 12 may sample the grayscale values using a clock signal, and apply the data voltages corresponding to the grayscale values to the data lines D1 to Dn in units of pixel rows (where, n may be an integer greater than zero).

The scan driver 13 may receive a clock signal, a scan start signal, and the like from the timing controller 11 to generate scan signals to be provided to scan lines S1, S2, S3, and Sm (where, m may be an integer greater than zero).

The scan driver 13 may sequentially provide the scan signals having pulses of a turn-on level to the scan lines S1, S2, S3, and Sm. The scan driver 13 may include scan stages configured in a form of shift registers. The scan driver 13 may generate the scan signals in a manner of sequentially transferring the scan start signal, which is a pulse form of a turn-on level, to a next scan stage under a control of the clock signal.

The light emission driver 14 may receive a clock signal, a light emission stop start signal, and the like from the timing controller 11 to generate light emission signals to be provided to light emission lines E1, E2, E3, and Eo. For example, the light emission driver 14 may sequentially provide light emission signals having pluses of a turn-off level to the light emission lines E1 to Eo (where, o may be an integer greater than zero). For example, each light emission stage of the light emission driver 14 may be configured in a form of a shift register, and may generate the light emission signals in a manner of sequentially transferring the light emission stop start signal, which is a pulse form of a turn-on level, to a next light emission stage under control of the clock signal.

The pixel unit 15 includes pixels. Each pixel PXij may be connected to corresponding data line, scan line, and light emission line. In addition, the pixels PXij may be connected to a first power line, a second power line, and an auxiliary power line (where, i and j may be natural numbers). The pixel PXij may refer to a pixel where a scan transistor is connected to an i-th scan line and a j-th data line.

Figure 2:
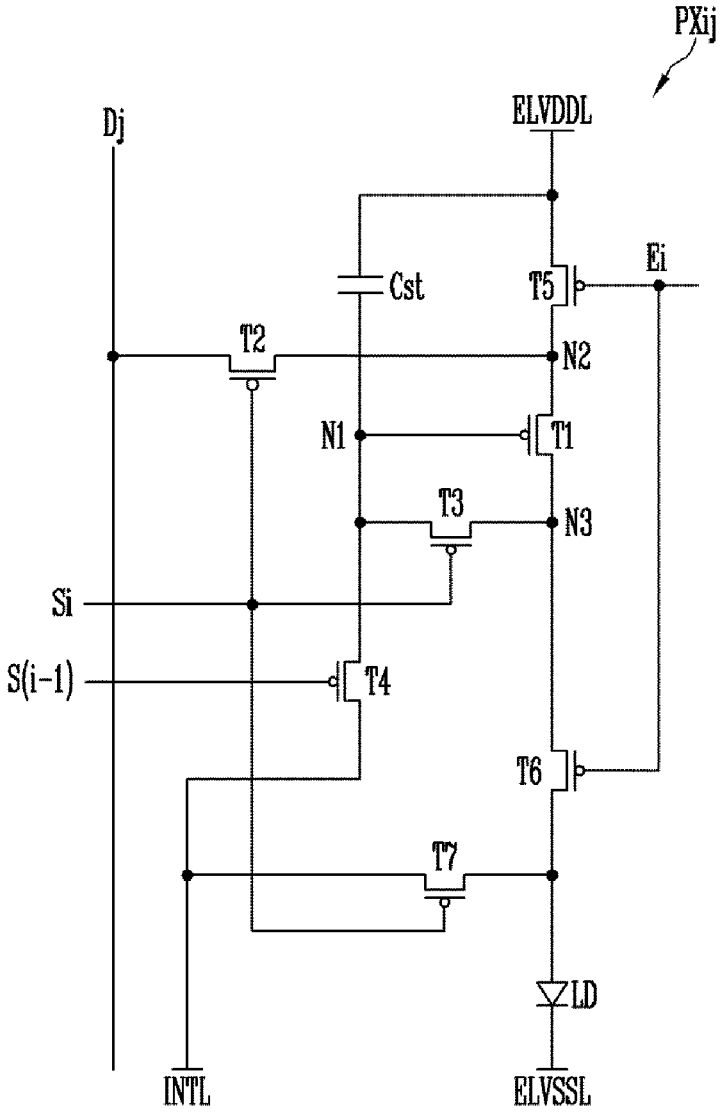
FIG. 2 shows a pixel according to an embodiment of the disclosure.

FIG. 2 shows a pixel according to an embodiment of the disclosure.

Referring to FIG. 2, the pixel PXij includes transistors T1, T2, T3, T4, T5, T6, and T7, a storage capacitor Cst, and a light emitting diode LD.

Hereinafter, a circuit configured of a P-type transistor will be described as an example. However, those skilled in the art will be able to design a circuit configured of an N-type transistor by differentiating a polarity of a voltage applied to a gate terminal. Similarly, those skilled in the art will be able to design a circuit configured of a combination of the P-type transistor and the N-type transistor. The P-type transistor is collectively referred to as a transistor in which an amount of current flowing when a voltage difference between a gate electrode and a source electrode increases in a negative direction. The N-type transistor is collectively referred to as a transistor in which an amount of current flowing when a voltage difference between a gate electrode and a source electrode increases in a positive direction. The transistor may be configured in various forms such as a thin film transistor ("TFT"), a field effect transistor ("FET"), and a bipolar junction transistor ("BJT").

The first transistor T1 may have a gate electrode connected to a first node N1, a first electrode connected to a second node N2, and a second electrode connected to a third node N3. The first transistor T1 may be referred to as a driving transistor.

The second transistor T2 may have a gate electrode connected to the i-th scan line Si, a first electrode connected to the data line Dj, and a second electrode connected to the second node N2. The second transistor T2 may be referred to as a scan transistor.

The third transistor T3 may have a gate electrode connected to the i-th scan line Si, a first electrode connected to the first node N1, and a second electrode connected to the third node N3. The third transistor T3 may be referred to as a diode-connected transistor.

The fourth transistor T4 may have a gate electrode connected to an (i−1)-th scan line S(i−1), a first electrode connected to the first node N1, and a second electrode connected to an initialization line INTL. In another embodiment, the gate electrode of the fourth transistor T4 may be connected to another scan line. The fourth transistor T4 may be referred to as a gate initialization transistor.

The fifth transistor T5 may have a gate electrode connected to the i-th light emission line Ei, a first electrode connected to a first power line ELVDDL, and a second electrode connected to the second node N2. The fifth transistor T5 may be referred to as a light emitting transistor. In another embodiment, the gate electrode of the fifth transistor T5 may be connected to another light emission line.

The sixth transistor T6 may have a gate electrode connected to the i-th light emission line Ei, a first electrode connected to the third node N3, and a second electrode connected to an anode of the light emitting diode LD. The sixth transistor T6 may be referred to as a light emitting transistor. In another embodiment, the gate electrode of the sixth transistor T6 may be connected to another light emission line.

The seventh transistor T7 may have a gate electrode connected to the i-th scan line, a first electrode connected to the initialization line INTL, and a second electrode connected to the anode of the light emitting diode LD. The seventh transistor T7 may be referred to as an anode initialization transistor. In another embodiment, the gate electrode of the seventh transistor T7 may be connected to another scan line.

A first electrode of the storage capacitor Cst may be connected to the first power line ELVDDL and a second electrode may be connected to the first node N1.

The anode of the light emitting diode LD may be connected to the second electrode of the sixth transistor T6 and the cathode may be connected to the second power line ELVSSL. The light emitting diode LD may include an organic light emitting diode, an inorganic light emitting diode, a quantum dot light emitting diode, or the like.

A first power voltage may be applied to the first power line ELVDDL, a second power voltage may be applied to the second power line ELVSSL, and an initialization voltage may be applied to the initialization line INTL. For example, the first power voltage may be greater than the second power voltage. Also, the initialization voltage may be equal to or greater than the second power voltage.

Figure 3:
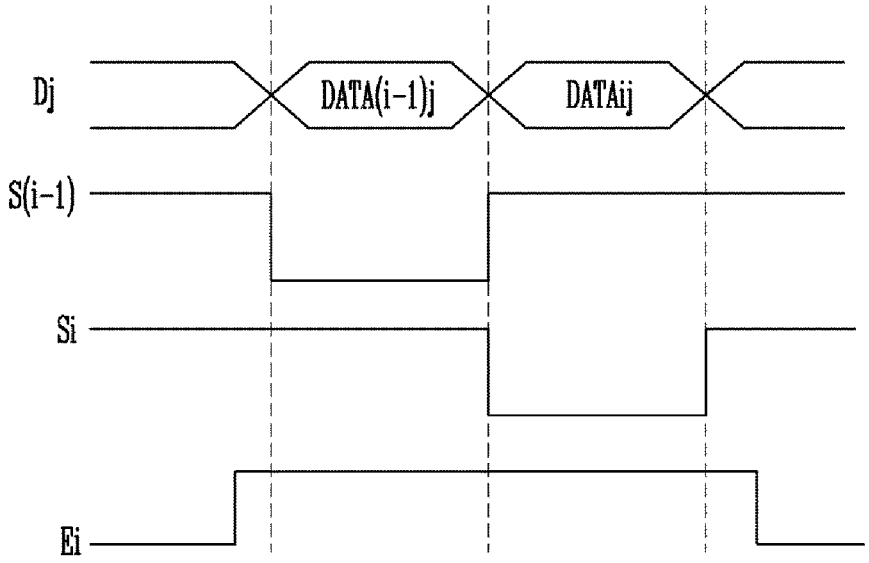
FIG. 3 shows a method of driving a pixel according to an embodiment of the disclosure.

FIG. 3 is a diagram for describing a method of driving a pixel according to an embodiment of the disclosure.

First, a data voltage DATA(i−1)j for an (i−1)-th pixel is applied to the data line Dj and a scan signal of a turn-on level (a low level) is applied to the (i−1)-th scan line S(i−1).

At this time, since a scan signal of a turn-off level (a high level) is applied to the i-th scan line Si, the second transistor T2 is turned off and the data voltage DATA(i−1)j is prevented from being drawn into the pixel PXij.

At this time, since the fourth transistor T4 is turned on, the first node N1 is connected to the initialization line INTL, and a voltage of the first node N1 is initialized. Since a light emission signal of a turn-off level is applied to the light emission line Ei, the transistors T5 and T6 are turned off and light emission of a light emitting diode LD according to an initialization voltage is prevented.

A data voltage DATAij for the i-th pixel PXij is applied to the data line Dj, and the scan signal of the turn-on level is applied to the i-th scan line Si. Therefore, the transistors T2, T1, and T3 are turned on, and the data line Dj and the first node N1 are electrically connected. Thus, a compensation voltage obtained by subtracting a threshold voltage of the first transistor T1 from the data voltage DATAij is applied to the second electrode (i.e., the first node N1) of the storage capacitor Cst, and the storage capacitor Cst maintains a voltage corresponding to a difference between the first power voltage and the compensation voltage. Such a period may be referred to as a threshold voltage compensation period.

Since the seventh transistor T7 is turned on, the anode of the light emitting diode LD is connected to the initialization line INTL, and the light emitting diode LD is initialized to a charge amount corresponding to a voltage difference between the initialization voltage and the second power voltage.

As the emission signal of the turn-on level is applied to the light emission line Ei, the transistors T5 and T6 may be turned on. Therefore, a driving current path is formed as a path of the first power line ELVDDL, the fifth transistor T5, the first transistor T1, the sixth transistor T6, the light emitting diode LD, and the second power line ELVSSL.

An amount of a driving current flowing through the first electrode and the second electrode of the first transistor T1 is controlled according to the voltage maintained in the storage capacitor Cst. The light emitting diode LD emits light at a luminance corresponding to the amount of the driving current. The light emitting diode LD emits the light until a light emission signal of a turn-off level is applied to the light emission line Ei.

Figure 4:
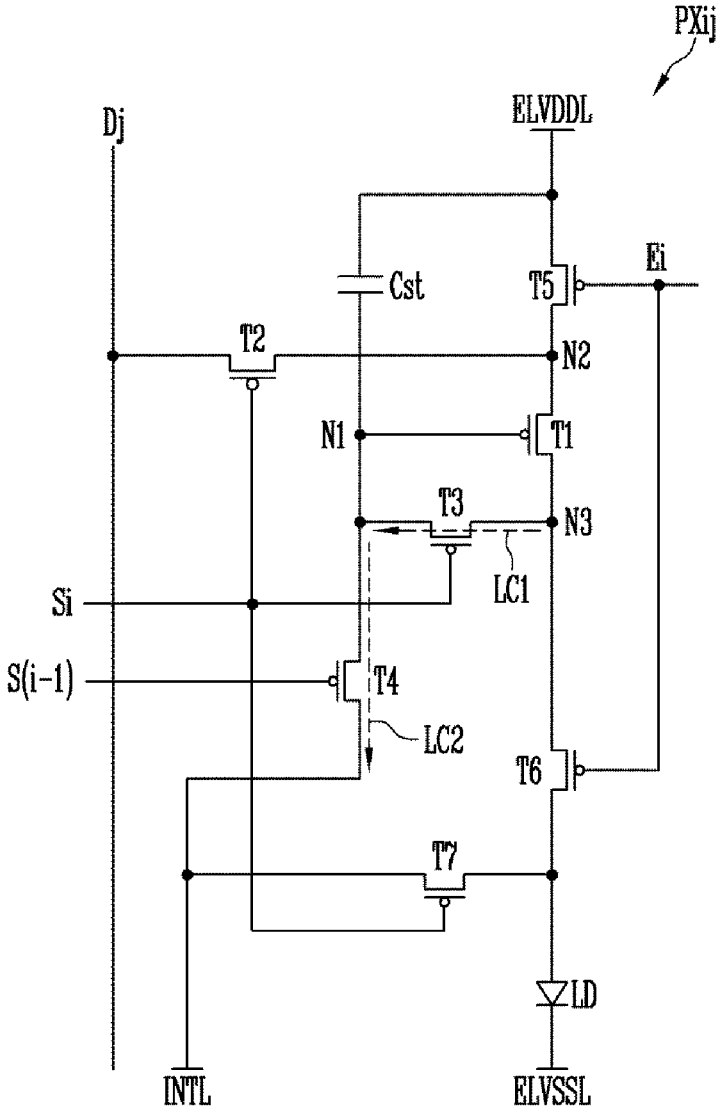
FIG. 4 shows an instance of a leakage current of a pixel.

FIG. 4 shows an instance of a leakage current of a pixel.

Ideally, when the scan signal of the turn-off level (high level) is applied to the gate electrodes of the transistors T3 and T4, a current flowing through the transistors T3 and T4 is required to be zero or very small in an amount thereof.

However, a leakage current LC1 may be generated through the third transistor T3 to be turned off in a light emission period of the light emitting diode LD. In addition, a leakage current LC2 may be generated through the fourth transistor T4 to be turned off outside an initialization period of the first node N1. As described above, when a leakage current is generated, information on an image frame may not be maintained, and thus an imaged may be deteriorated or otherwise experience a flicker thereof.

Figure 5:
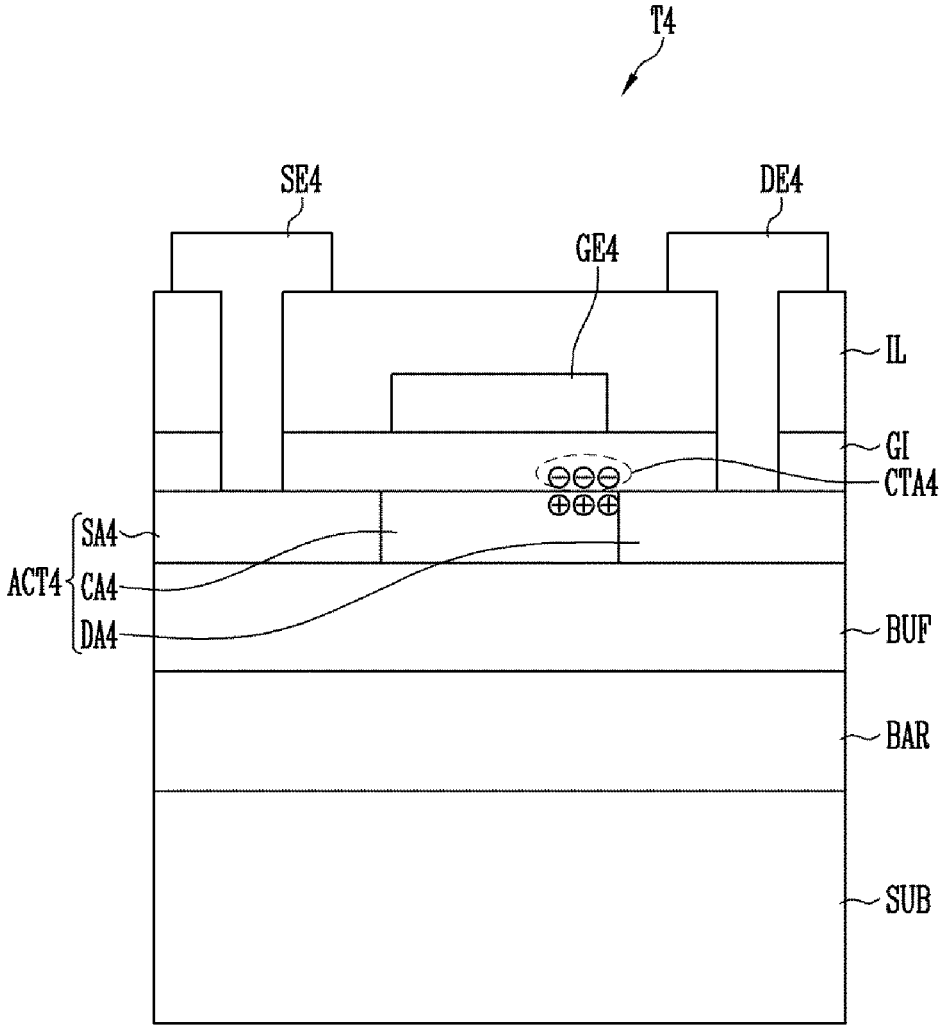
FIG. 5 shows a structure of a fourth transistor.

FIG. 5 shows a structure of the fourth transistor.

Referring to FIG. 5, the fourth transistor T4 may include a gate electrode GE4, a source electrode SE4, a drain electrode DE4, and a semiconductor layer ACT4. The semiconductor layer ACT4 may include a source region SA4, a channel region CA4, and a drain region DA4. The source electrode SE4 may be connected to the source region SA4 and the drain electrode DE4 may be connected to the drain region DA4.

The substrate SUB may be formed of various materials such as glass, polymer, and metal. The substrate SUB may be selected from a rigid substrate and a flexible substrate according to an application product. When the substrate SUB is configured to include a polymer organic material, the substrate SUB may be formed of polystyrene, polyvinyl alcohol, polymethyl methacrylate, polyethersulfone, polyacrylate, polyetherimide, polyethylene naphthalate, polyethylene terephthalate, polyphenylene sulfide, polyarylate, polyimide, polycarbonate, triacetate cellulose, cellulose acetate propionate, and the like. On the other hand, the substrate SUB may be formed of fiber glass reinforced plastic ("FRP").

A barrier layer BAR may be positioned on the substrate SUB. In addition, a buffer layer BUF may be positioned on the barrier layer BAR. In addition, the semiconductor layer ACT4 may be positioned on the buffer layer BUF.

The barrier layer BAR and the buffer layer BUF may be layers selectively included in the semiconductor layer ACT4 to prevent diffusion of impurities of the substrate SUB or moisture transmission to the semiconductor layer ACT4. The barrier layer BAR and the buffer layer BUF may be insulating layers. For example, the barrier layer BAR and the buffer layer BUF may be formed of silicon nitride (SiNx), silicon oxide (SiOx), silicon oxynitride (SiOxNy), or the like.

The semiconductor layer ACT4 may be formed of polysilicon, amorphous silicon, an oxide semiconductor, an organic semiconductor, an inorganic semiconductor, or the like. The semiconductor layer ACT4 may include a source region SA4, a channel region CA4, and a drain region DA4.

As described above, when it is assumed that the fourth transistor T4 is the P-type transistor, each of the source region SA4 and the drain region DA4 may be doped with an acceptor. The first electrode of the fourth transistor T4 may be the source electrode SE4, and the second electrode may be the drain electrode DE4.

On the other hand, when it is assumed that the fourth transistor T4 is the N-type transistor, each of the source region SA4 and the drain region DA4 may be doped with a donor. The first electrode of the fourth transistor T4 may be the drain electrode DE4 and the second electrode may be the source electrode SE4.

Hereinafter, it is assumed that the fourth transistor T4 is a P-type transistor.

A gate insulating layer GI may be positioned on the semiconductor layer ACT4. For example, the gate insulating layer GI may be formed of silicon nitride (SiNx), silicon oxide (SiOx), silicon oxynitride (SiOxNy), or the like. A region of the gate insulating layer GI adjacent to the drain region DA4 may have an electron density higher than that of a region of the gate insulating layer GI adjacent to the source region SA4. For example, a charge trap region CTA4 may be present in the region of the gate insulating layer GI adjacent to the drain region DA4. Electrons trapped in a lattice of the gate insulating layer (GI) and fixed in position may be held in the charge trap region CTA4.

The gate electrode GE4 may be a conductor. For example, the gate electrode GE4 may be formed using gold (Au), silver (Ag), aluminum (Al), molybdenum (Mo), chromium (Cr), titanium (Ti), nickel (Ni), neodymium (Nd), copper (Cu), platinum (Pt), or the like.

An insulating layer IL may be positioned on the gate electrode GE4 and the gate insulating layer GI. For example, the insulating layer IL may be formed of silicon nitride (SiNx), silicon oxide (SiOx), silicon oxynitride (SiOxNy), or the like.

The source electrode SE4 and the drain electrode DE4 may be positioned on the insulating layer IL. The source electrode SE4 may be connected to the source region SA4 through a contact hole of the insulating layer IL and the gate insulating layer GI. The drain electrode DE4 may be connected to the drain region DA4 through the contact hole of the insulating layer IL and the gate insulating layer GI. The source electrode SE4 and the drain electrode DE4 may be formed using gold (Au), silver (Ag), aluminum (Al), molybdenum (Mo), chromium (Cr), titanium (Ti), nickel (Ni), neodymium (Nd), copper (Cu), platinum (Pt), or the like.

Each of the layers and electrodes described above may be configured of a single layer or a plurality of layers.

Hereinafter, a method of aging a transistor according to an embodiment of the disclosure will be described.

When the transistor of a display device such as a display device 10 is continuously used, a characteristic of the transistor may or may not be rapidly changed for a certain initial period.

An aging process of a transistor may be a process for preventing a change in the characteristic of the transistor even though a user uses the display device 10 continuously. The aging process may include applying stress to the transistor as the display device 10 including the transistor is manufactured.

The method of aging the fourth transistor according to an embodiment of the disclosure may be performed by applying a bias voltage higher than that of the drain electrode DE4 to the gate electrode GE4 of the fourth transistor T4. Therefore, electrons are trapped in the lattice of the gate insulating layer GI and thus the charge trap region CTA4 may be formed.

Figure 6:
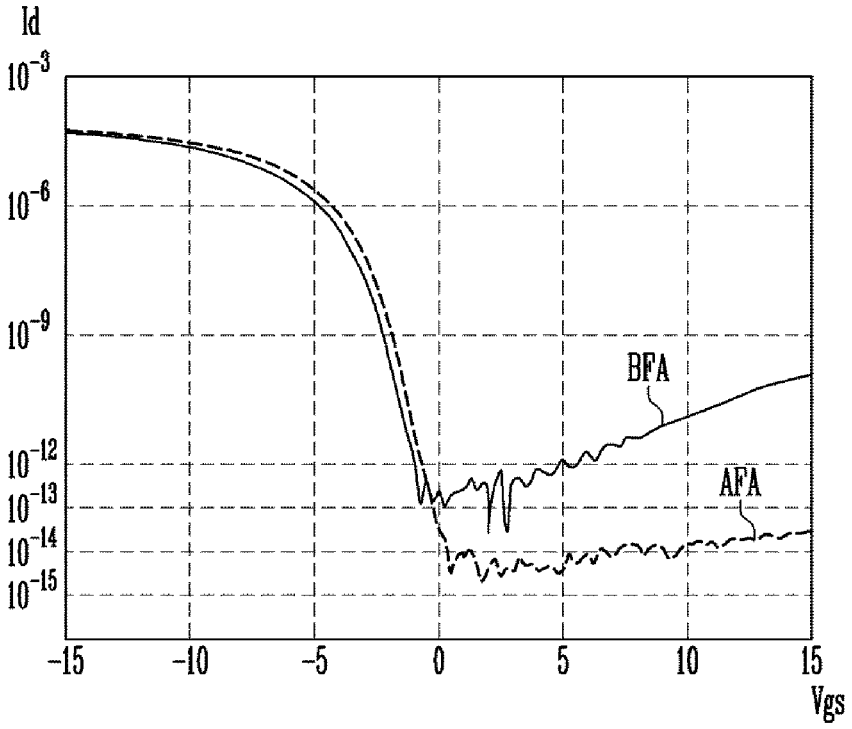
FIG. 6 is a diagram for comparing a leakage current of a transistor before and after aging.

FIG. 6 is a diagram for comparing a leakage current of the transistor before and after aging.

Referring to FIG. 6, a graph of a gate-source voltage Vgs versus drain current Id of the transistor is shown.

Referring to a graph AFA when the aging process is performed and a graph BFA when the aging process is not performed, it may be confirmed that the leakage current is alleviated when the aging process is performed.

When a high level voltage is applied to the gate electrode of the P-type transistor, it is ideal that the transistor is turned off, such that the leakage current is not generated. However, due to a gate induced drain leakage ("GIDL") phenomenon, a leakage current may still be generated even though a high level voltage is applied to the gate electrode.

A main reason of the GIDL phenomenon is tunneling according to an electric field generated between the gate electrode and the drain electrode. Referring to FIG. 5 again, the fourth transistor T4 according to an embodiment of the disclosure has a structure in which an electric field generated by the charge trap region CTA4 compensates a certain portion of the electric field between the gate electrode and the drain electrode, and thus the GIDL phenomenon may be alleviated.

The aging process described with reference to FIGS. 5 and 6 pertains mainly to the P-type transistor, but the aging process described herein may be applied similarly to the N-type transistor.

For example, the aging process may be performed by applying a bias voltage lower than that of the drain electrode DE4 to the gate electrode GE4 of the N-type fourth transistor T4. Therefore, holes may be trapped in the lattice of the gate insulating layer GI, and thus the charge trap region CTA4 may be formed. Thus, the region of the gate insulating layer GI adjacent to the drain region DA4 may have a hole density higher than that of the region of the gate insulating layer GI adjacent to the source region SA4.

Referring to FIG. 4, since the gate electrode of the fourth transistor T4 is connected to the (i−1)-th scan line S(i−1) and the drain electrode of the fourth transistor T4 is connected to the initialization line INTL, a voltage suitable for the aging process may be conveniently applied to the gate electrode and the drain electrode of the transistor T4.

However, a voltage may not be applied directly to the drain electrode of the third transistor T3, and thus it is difficult to perform aging on the third transistor T3.

Figure 7:
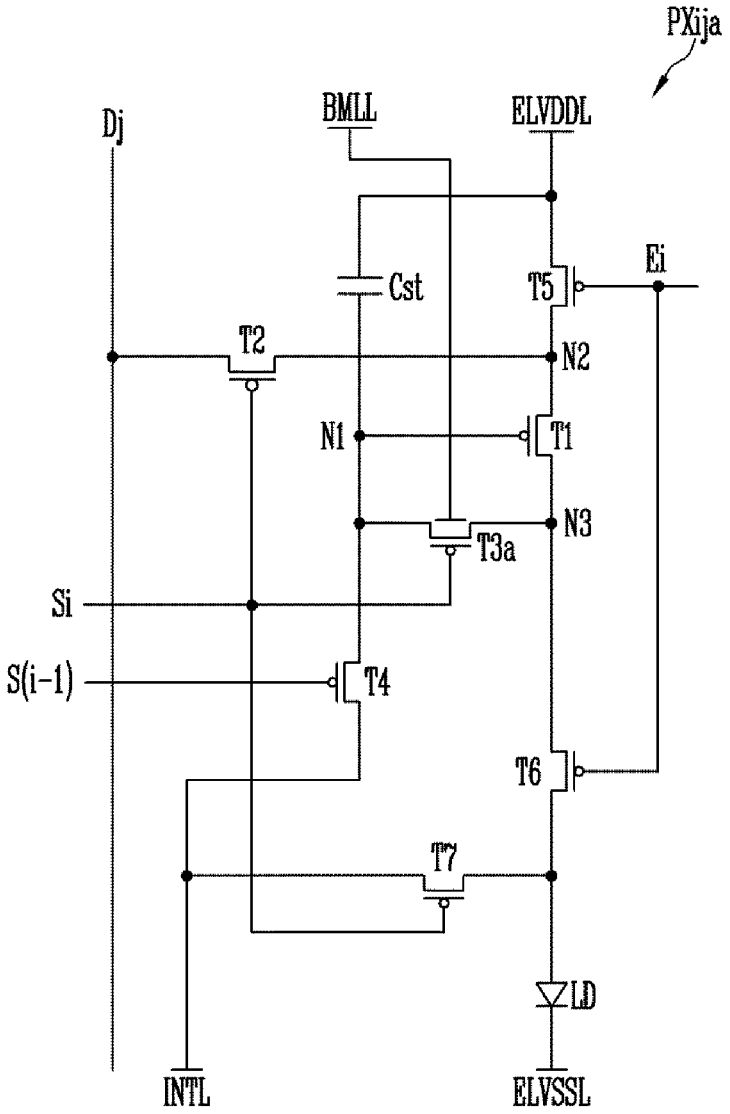
FIG. 7 shows a pixel according to another embodiment of the disclosure.

FIG. 7 shows a pixel according to another embodiment of the disclosure.

In a pixel PXij a of FIG. 7, a configuration of a third transistor T3*a* is changed as compared with the pixel PXij of FIG. 2.

Referring to FIG. 7, the third transistor T3*a* may include a second gate electrode. An electrical node of the second gate electrode may be different from the first gate electrode. The second gate electrode may be connected to an auxiliary power line BMLL. The auxiliary power line BMLL and the second gate electrode connected to the auxiliary power line BMLL may always be in a floating state. For example, the auxiliary power line BMLL may not be configured to be powered. In other words, when the user uses the display device 10, the auxiliary power line BMLL may not be powered since the aging process occurs prior to the use by the user.

According to an embodiment of the disclosure, the auxiliary power line BMLL may therefore be used in an aging process of the third transistor T3*a*. For example, in the aging process, the auxiliary power line BMLL may be connected to auxiliary power, and after the aging process, the auxiliary power line BMLL may be disconnected from the auxiliary power.

Figure 8:
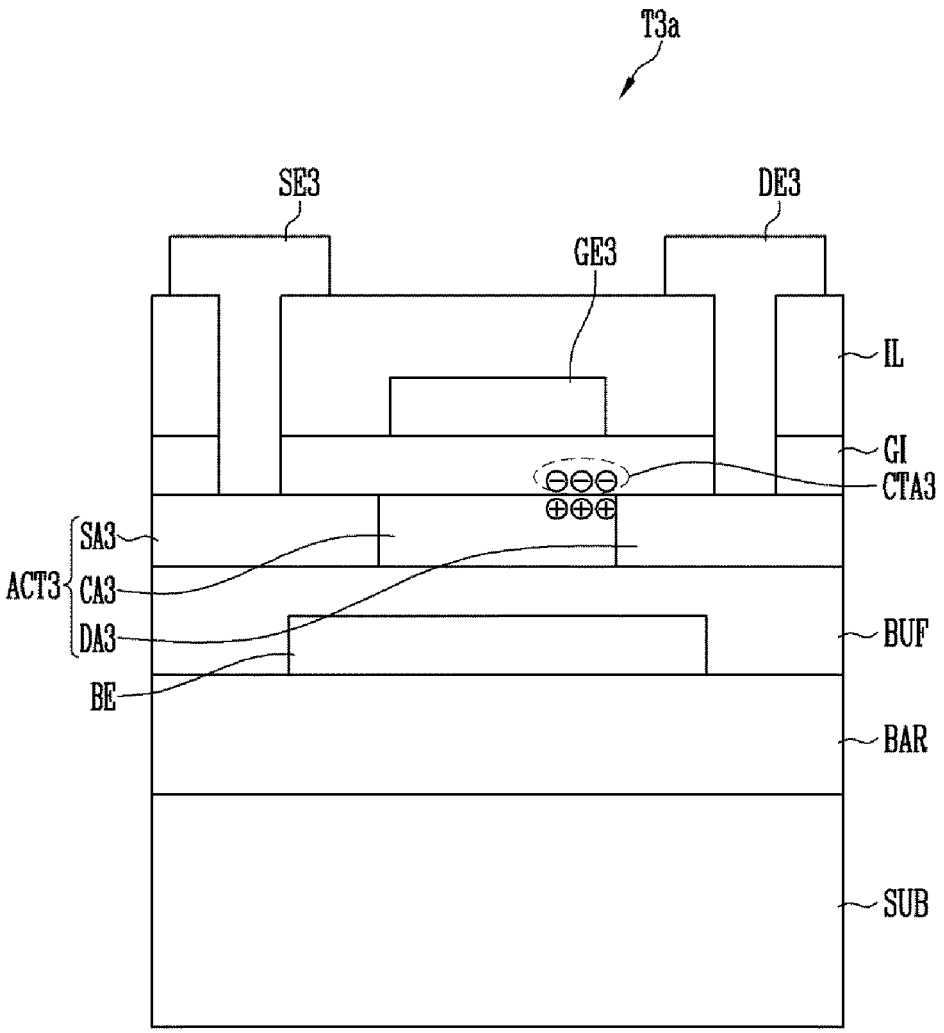
FIG. 8 shows a structure of a third transistor according to an embodiment of the disclosure.

FIG. 8 shows a structure of the third transistor according to an embodiment of the disclosure.

Referring to FIG. 8, the third transistor T3*a* may include a first gate electrode GE3, a source electrode SE3, a drain electrode DE3, and a semiconductor layer ACT3. The semiconductor layer ACT3 may include a source region SA3, a channel region CA3, and a drain region DA3. The source electrode SE3 may be connected to the source region SA3 and the drain electrode DE3 may be connected to the drain region DA3.

The barrier layer BAR may be positioned on the substrate SUB.

A second gate electrode BE may be positioned on the barrier layer BAR. The second gate electrode BE may be a conductor. The second gate electrode BE may be formed using gold (Au), silver (Ag), aluminum (Al), molybdenum (Mo), chromium (Cr), titanium (Ti), nickel (Ni), neodymium (Nd), copper (Cu), platinum (Pt), or the like.

In the embodiment of FIG. 8, at least a part of the second gate electrode BE may overlap the source region SA3, the channel region CA3, and the drain region DA3. For example, the second gate electrode BE may overlap the source region SA3, overlap the channel region CA3, and overlap the drain region DA3.

The buffer layer BUF may be positioned on the barrier layer BAR and the second gate electrode BE. In addition, the semiconductor layer ACT3 may be positioned on the buffer layer BUF. The semiconductor layer ACT3 may be positioned between the first gate electrode GE3 and the second gate electrode BE.

The semiconductor layer ACT3 may be formed of polysilicon, amorphous silicon, an oxide semiconductor, an organic semiconductor, an inorganic semiconductor, or the like. The semiconductor layer ACT3 may include the source region SA3, the channel region CA3, and the drain region DA3.

As described above, when it is assumed that the third transistor T3*a* is the P-type transistor, each of the source region SA3 and the drain region DA3 may be doped with an acceptor. Thus, the first electrode of the third transistor T3*a* may be the drain electrode DE3 and the second electrode may be the source electrode SE3.

On the other hand, when it is assumed that the third transistor T3*a* is the N-type transistor, each of the source region SA3 and the drain region DA3 may be doped with a donor. Thus, the first electrode of the third transistor T3*a* may be the source electrode SE3 and the second electrode may be the drain electrode DE3.

Hereinafter, it is assumed that the third transistor T3*a* is the P-type transistor.

The gate insulating layer GI may be positioned on the semiconductor layer ACT3. The gate insulating layer GI may be positioned between the first gate electrode GE3 and the semiconductor layer ACT3.

A region of the gate insulating layer GI adjacent to the drain region DA3 may have an electron density higher than that of a region of the gate insulating layer GI adjacent to the source region SA3. For example, a charge trap region CTA3 may be present in the region of the gate insulating layer GI adjacent to the drain region DA3. Electrons trapped in a lattice of the gate insulating layer (GI) and fixed in position may be held in the charge trap region CTA3.

The insulating layer IL may be positioned on the first gate electrode GE3 and the gate insulating layer GI.

The source electrode SE3 and the drain electrode DE3 may be positioned on the insulating layer IL. The source electrode SE3 may be connected to the source region SA3 through the contact hole of the insulating layer IL and the gate insulating layer GI. The drain electrode DE3 may be connected to the drain region DA3 through the contact hole of the insulating layer IL and the gate insulating layer GI.

Each of the layers and electrodes described above may be configured of a single layer or a plurality of layers.

Hereinafter, a method of aging the third transistor T3*a* according to an embodiment of the disclosure will be described.

The method of aging the third transistor T3*a* according to an embodiment of the disclosure may be performed by applying a bias voltage higher than that of the drain electrode DE3 to the first gate electrode GE3. At this time, a voltage lower than that of the first gate electrode GE3 may be applied to the second gate electrode BE. That is, the above-described auxiliary power may provide the voltage lower than that of the first gate electrode GE3 to the second gate electrode BE through the auxiliary power line BMLL.

According to an embodiment of the disclosure, in a situation where it is difficult to directly apply the voltage lower than that of the first gate electrode GE3 to the drain electrode DE3, the voltage lower than that of the first gate electrode GE3 may be directly applied to the second gate electrode BE. Therefore, an electric field between the first gate electrode GE3 and the drain electrode DE3 is strengthened. Thus, the electrons may be effectively trapped in the lattice of the gate insulating layer GI based on the charge trap region CTA3.

Reduction of the leakage current due to the alleviation of the GIDL phenomenon due to the charge trap region CTA3 is the same as that described with reference to FIG. 6.

As described, even though the third transistor T3*a* is configured of the P-type, an aging process of the same principle may be performed for an N-type transistor that is the third transistor T3*a*.

For example, when the third transistor T3*a* is configured of the N type, the source region SA3 and the drain region DA3 may be doped with a donor.

The aging method according to an embodiment of the disclosure may include applying a voltage lower than that of the drain region DA3 to the first gate electrode GE3. That is, the voltage lower than that of the drain electrode DE3 may be applied to the first gate electrode GE3. In addition, the aging method may include applying a voltage higher than that of the first gate electrode GE3 to the second gate electrode BE. Therefore, holes may be trapped in the lattice of the gate insulating layer GI, and thus the charge trap region CTA3 may be formed. As such, the region of the gate insulation layer GI adjacent to the drain region DA3 may have a hole density higher than that of the region of the gate insulation (GI) layer adjacent to the source region SA3.

Figure 9:
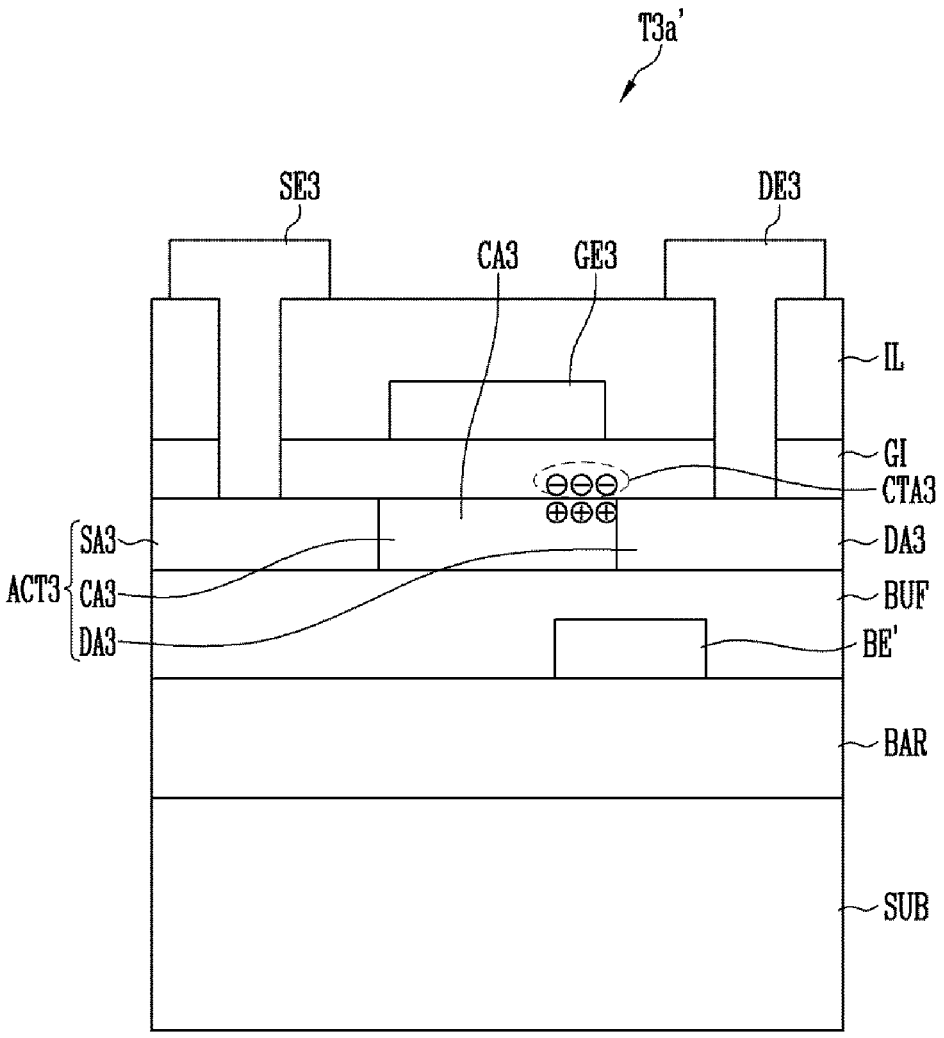
FIG. 9 shows a structure of the third transistor according to another embodiment of the disclosure.

FIG. 9 shows a structure of the third transistor according to another embodiment of the disclosure.

A third transistor T3*a*' of FIG. 9 is different from the third transistor T3*a* of FIG. 8 with respect to a second gate electrode BE'.

At least a part of the second gate electrode BE' may overlap the drain region DA3. In addition, the second gate electrode BE' may not overlap the source region SA3.

According to the foregoing description, the charge trap region CTA3 is required to be formed in a portion close to the drain region DA3 of the gate insulating layer GI. Therefore, it is sufficient that an electric field provided by the second gate electrode BE' is provided to the drain region DA3.

FIGS. 10 to 13 show a pixel according to another embodiment of the disclosure.

Figure 10:
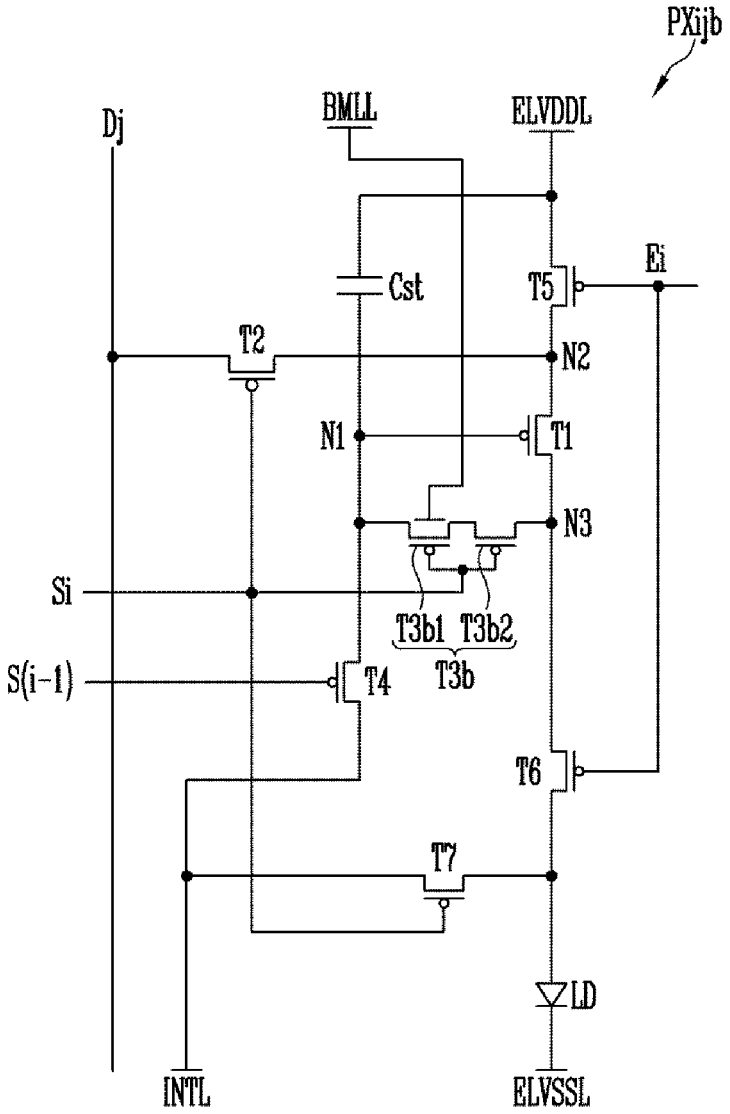
FIGS. 10 to 13 shows a pixel according to another embodiment of the disclosure.

In a pixel PXijb of FIG. 10, a configuration of a third transistor T3*b* may differ from the pixel PXija of FIG. 7. Repetitive descriptions of the same configuration of the pixel PXijb and the pixel PXija will be omitted.

The third transistor T3*b* may include a first sub-transistor T3*b*1 and a second sub-transistor T3*b*2.

The first sub-transistor T3*b*1 may have a sub-gate electrode connected to the i-th scan line Si, a first electrode connected to the first node N1, a second electrode connected to the first electrode of the second sub-transistor T3*b*2.

The second sub-transistor T3*b*2 may have a sub-gate electrode connected to the i-th scan line Si, a first electrode connected to the second electrode of the first sub-transistor T3*b*1, a second electrode connected to the third node N3.

Each of the sub-gate electrodes which are shown in FIG. 10 as being connected to the i-th scan line Si is distinct from the gate electrode GE3, as is shown in FIG. 8, for example. That is, each sub-gate electrode forms a separate connection of the third transistor T3*a* to the scan line Si.

The first sub-transistor T3*b*1 may include a second gate electrode. The second gate electrode may be connected to the auxiliary power line BMLL. A structure of the first sub-transistor T3*b*1 may include the structure of the third transistors of FIG. 8 and FIG. 9.

However, the second sub-transistor T3*b*2 may not include the second gate electrode. A structure of the second sub-transistor T3*b*2 may include the structure of the transistor T4 of FIG. 5.

In order to prevent a leakage current, the first sub-transistor T3*b*1 and the second sub-transistor T3*b*2 may be connected in series. Since the first sub-transistor T3*b*1 and the second sub-transistor T3*b*2 connected in series share the same current path, the aging process may be performed only on the first sub-transistor T3*b*1 to alleviate the leakage current.

Figure 11:
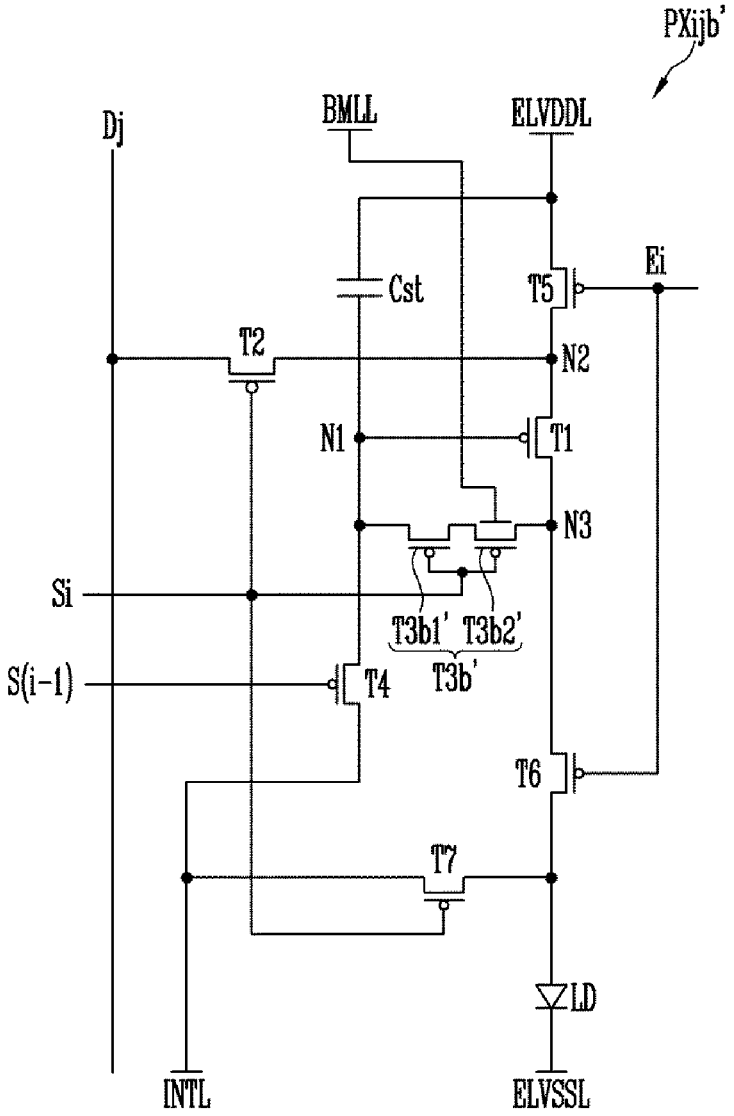

In a pixel PXijb' of FIG. 11, a configuration of a third transistor T3*b*' may differ from the pixel PXija of FIG. 7.

The third transistor T3*b*' may include a first sub-transistor T3*b*1' and a second sub-transistor T3*b*2'.

The first sub-transistor T3*b*1' may have a sub-gate electrode connected to the i-th scan line Si, a first electrode connected to the first node N1, a second electrode connected to the first electrode of the second sub-transistor T3*b*2'.

The second sub-transistor T3*b*2' may have a sub-gate electrode connected to the i-th scan line Si, a first electrode connected to the second electrode of the first sub-transistor T3*b*1', and a second electrode connected to the third node N3.

At this time, the first sub-transistor T3*b*1' may not include the second gate electrode. A structure of the first sub-transistor T3*b*1' may include the structure of the transistor T4 of FIG. 5.

However, the second sub-transistor T3*b*2' may include the second gate electrode. The second gate electrode may be connected to the auxiliary power line BMLL. A structure of the second sub-transistor T3*b*2' may follow the structure of the transistors of FIG. 8 and FIG. 9.

In order to prevent a leakage current, the first sub-transistor T3*b*1' and the second sub-transistor T3*b*2' may be connected in series. Since the first sub-transistor T3*b*1' and the second sub-transistor T3*b*2' connected in series share the same current path, the aging process may be performed only on the second sub-transistor T3*b*2' to alleviate the leakage current.

Figure 12:
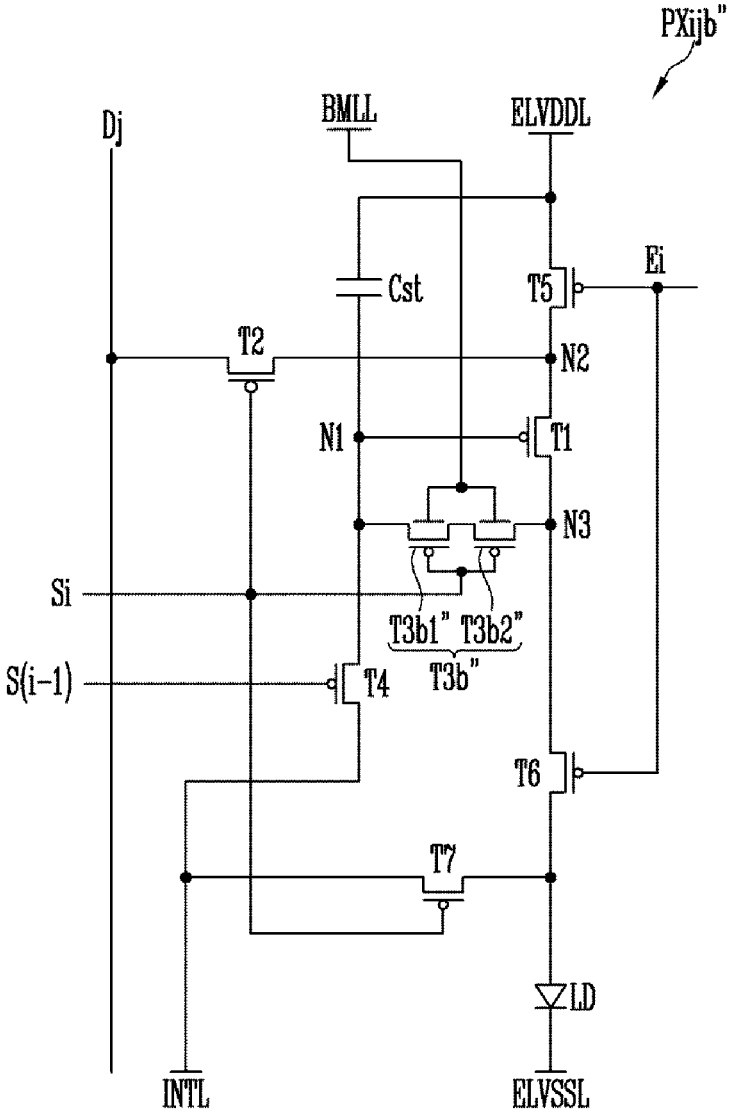

In a pixel PXijb" of FIG. 12, a configuration of a third transistor T3*b*" may differ from the pixel PXija of FIG. 7.

The third transistor T3*b*" may include a first sub-transistor T3*b*1" and a second sub-transistor T3*b*2".

The first sub-transistor T3*b*1" may have a sub-gate electrode connected to the i-th scan line Si, a first electrode connected to the first node N1, and a second electrode connected to the first electrode of the second sub-transistor T3*b*2".

The second sub-transistor T3*b*2" may have a sub-gate electrode connected to the i-th scan line Si, a first electrode connected to the second electrode of the first sub-transistor T3*b*1", and a second electrode connected to the third node N3.

The first sub-transistor T3*b*1" and the second sub-transistor T3*b*2" may include a second gate electrode. The second gate electrode may be connected to the auxiliary power line BMLL. Structures of the first sub-transistor T3*b*1" and the second sub-transistor T3*b*2" may follow the structure of the transistors of FIG. 8 and FIG. 9.

Figure 13:
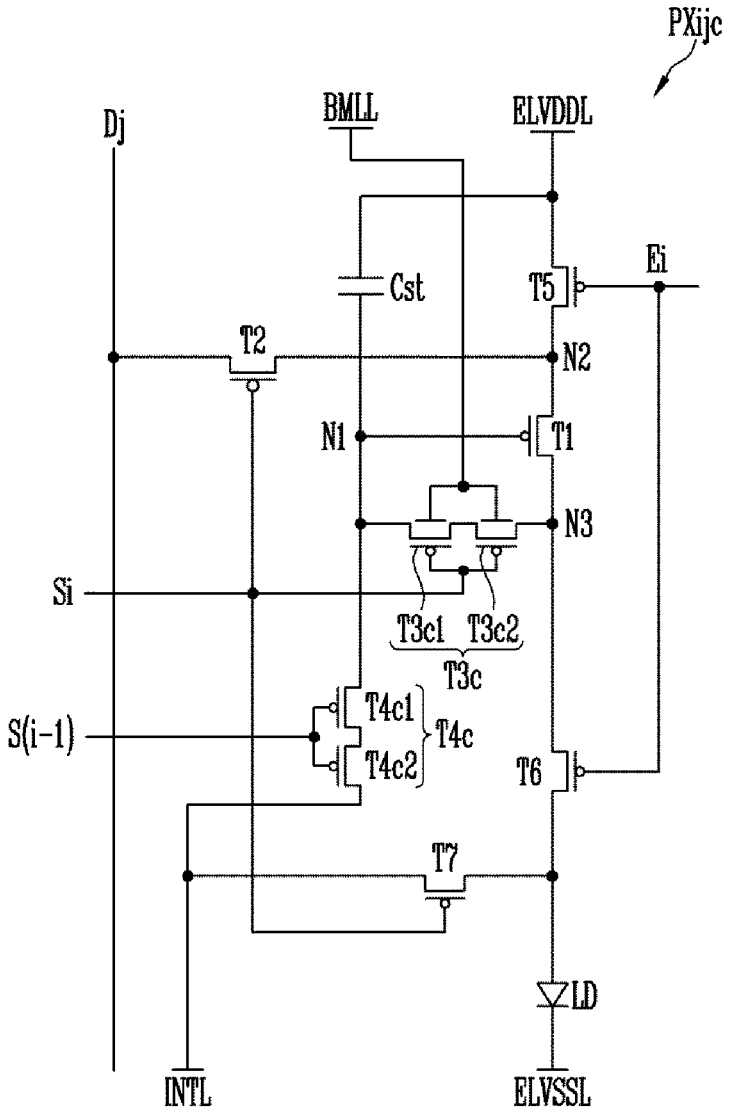

In a pixel PXijc of FIG. 13, configurations of a third transistor T3*c* and a fourth transistor T4*c* may differ from the pixel PXija of FIG. 7.

The third transistor T3*c* may include a first sub-transistor T3*c*1 and a second sub-transistor T3*c*2.

The first sub-transistor T3*c*1 may have a sub-gate electrode connected to the i-th scan line Si, a first electrode connected to the first node N1, a second electrode connected to the first electrode of the second sub-transistor T3*c*2.

The second sub-transistor T3*c*2 may have a sub-gate electrode connected to the i-th scan line Si, a first electrode connected to the second electrode of the first sub-transistor T3*c*1, a second electrode connected to the third node N3.

The first sub-transistor T3*c*1 and the second sub-transistor T3*c*2 may include a second gate electrode. The second gate electrode may be connected to the auxiliary power line BMLL. Structures of the first sub-transistor T3*c*1 and the second sub-transistor T3*c*2 may follow the structure of the transistors of FIG. 8 and FIG. 9.

The pixel PXijc of FIG. 13 includes sub-transistors T4*c*1 and T4*c*2 in which the fourth transistors T4*c* are connected in series in order to reduce the leakage current LC2 described above with reference to FIG. 4.

The sub-transistor T4*c*1 may have a gate electrode connected to the (i−1)-th scan line S(i−1), a first electrode connected to the first node (N1), and a second electrode connected to a first electrode of the sub-transistor T4*c*2.

The sub-transistor T4*c*2 may have a gate electrode connected to the (i−1)-th scan line S(i−1), the first electrode connected to the second electrode of the sub-transistor T4*c*1, and a second electrode connected to the initialization line INTL.

Each of the sub-transistors T4*c*1 and T4*c*2 may follow the structure of the transistor T4 of FIG. 5.

Figure 14:
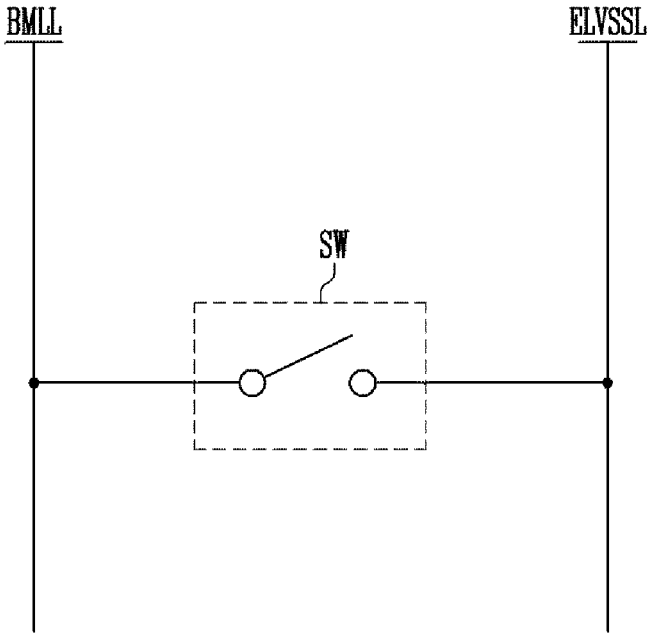
FIGS. 14 to 16 show an auxiliary power line for alleviating a momentary afterimage.
Figure 15:
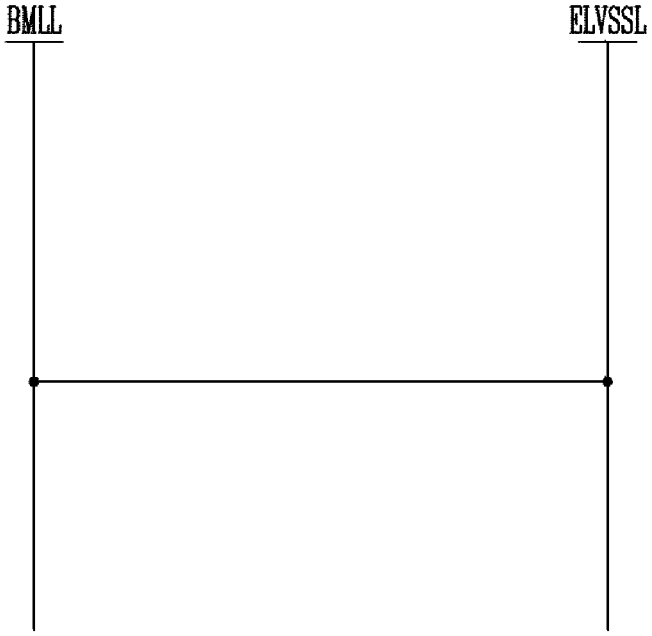
Figure 16:
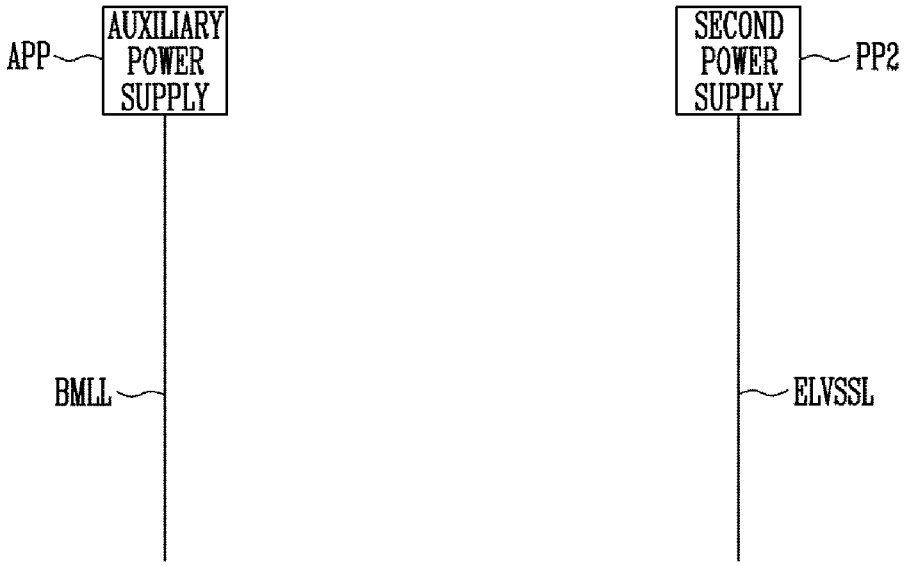

FIGS. 14 to 16 show an auxiliary power line for alleviating a momentary afterimage.

The above-described embodiments are applicable even though the auxiliary power line BMLL of the display device 10 is always maintained in the floating state.

However, in the embodiments of FIGS. 14 to 16, momentary afterimage may be alleviated by configuring the auxiliary power line BMLL to receive power after the driving the display device 10 has been manufactured and is readied for delivery to a user. That is, in the embodiments of FIGS. 14 to 16, the auxiliary power line BMLL may not always be maintained in the floating state.

A hysteresis characteristic may arise when, with respect to the gate-source voltage versus drain current curve of the first transistor T1, a data voltage of a current image frame is higher than a data voltage of a previous image frame and the data voltage of the current image frame is lower than the data voltage of the previous image frame. Therefore, when the hysteresis characteristic appears strongly in an instance in which the same gate-source voltage is applied, the amount of the driving current flowing through the first transistor T1 may vary so as to cause the light emitting diode LD to not emit light at an appropriate luminance corresponding to the grayscale value.

When the display device 10 displays a still image, the first transistors of the pixels receive the same gate-source voltage during several tens to several hundreds of image frame periods. Therefore, when the hysteresis characteristics of the first transistors are maximized in the still image and the display device 10 switches the image, the pixels may not emit light appropriately at the luminance corresponding to the grayscale value. When afterimage persists, continuance of the same may be regarded as momentary afterimage. Such momentary afterimage may last for a few seconds and be perceived by the user of a display device for that corresponding amount of time.

In order to address and prevent such a momentary afterimage, a number of techniques may be implemented. For example and with respect to the embodiments of FIGS. 14 to 16, an absolute value of a threshold voltage of the third transistor may be reduced by applying a voltage lower than that of the first gate electrode to the second gate electrode of the third transistor. Therefore, a switching speed of the third transistor is increased to advance a turn-on time of the third transistor, thereby alleviating the degree and/or existence of momentary afterimage.

Referring to FIG. 14, the auxiliary power line BMLL and the second power line ELVSSL may be connected through a switch SW.

The switch SW may be turned off at the time of the aging of the display device 10. Therefore, an appropriate voltage for the aging may be applied to the auxiliary power line BMLL. In another embodiment, the switch SW may be turned on when it is appropriate to apply the second power voltage to the auxiliary power line BMLL at the time of the aging of the display device 10.

The switch SW may also be turned on at the time of driving the display device 10. Therefore, the second power line ELVSSL may be connected to the auxiliary power line BMLL. Generally, since the second power voltage of the voltages applied to the pixel is the lowest voltage, a voltage lower than that of the first gate electrode may be applied to the second gate electrode of the third transistor. According to an embodiment, at the time of driving the display device 10, the switch SW may not always turned on, but a timing thereof may be appropriately set to address the momentary afterimage.

Referring to FIG. 15, the auxiliary power line BMLL and the second power line ELVSSL may be directly connected with each other. That is, the second gate electrode may be connected to the cathode of the light emitting diode LD (see FIG. 7).

Therefore, the second power voltage lower than that of the first gate electrode may be applied to the second gate electrode both at the time of the aging process and at the time of the driving of the display device 10. Therefore, the leakage current alleviation and the momentary afterimage alleviation may be simultaneously achieved.

Referring to FIG. 16, an auxiliary power supply APP may be connected to the auxiliary power line BMLL and a second power supply PP2 may be connected to the second power line ELVSSL.

The auxiliary power supply APP may provide a voltage corresponding to the above-described embodiments to the auxiliary power line BMLL at the time of the aging process and at the time of the driving.

The second power supply PP2 may provide the second power voltage corresponding to the above-described embodiments to the second power line ELVSSL at the time of the aging process and at the time of the driving.

In the embodiment of FIG. 16, the auxiliary power line BMLL and the second power line ELVSSL are separated from each other, and thus a voltage control may be easily performed.

In FIGS. 14 to 16, it is assumed that the third transistor is configured of the P-type transistor.

In another embodiment, when the third transistor is configured of the N-type transistor, in the embodiments of FIGS. 14 to 16, the absolute value of the threshold voltage may be reduced by applying a voltage higher than that of the first gate electrode to the second gate electrode of the third transistor.

Thus, the second power line ELVSSL of FIGS. 14 to 16 may be replaced with the first power line ELVDDL. In addition, the second power supply PP2 of FIG. 16 may be replaced with the first power supply.

The aforementioned description is provided to exemplify and describe the invention. In addition, the aforementioned description simply exemplifies and describes embodiments of the disclosure, may be applied to various other combinations, modifications, and environments as set forth above, and may be changed or modified within the scope of the invention.

What is claimed is:

1. A display device comprising:

pixels;

wherein each of the pixels comprises:

a first transistor having a gate electrode directly electrically connected to a first node, a first electrode directly electrically connected to a second node, and a second electrode directly electrically connected to a third node;

a second transistor having a gate electrode connected to a first scan line, a first electrode connected to a data line, and a second electrode directly electrically connected to the second node; and a third transistor having a first gate electrode connected to the first scan line, a second gate electrode, a first electrode directly electrically connected to the first node, and a second electrode directly electrically connected to the third node.

2. The display device according to claim 1, wherein the second gate electrode is in a floating state.

3. The display device according to claim 1, wherein the third transistor comprises a semiconductor layer disposed between the first gate electrode and the second gate electrode, and the semiconductor layer includes a source region, a channel region, and a drain region.

4. The display device according to claim 3, wherein the second gate electrode is disposed to overlap at least a part of at least one of the source region, the channel region, and the drain region.

5. The display device according to claim 4, wherein the third transistor further comprises a gate insulating layer disposed between the first gate electrode and the semiconductor layer, wherein the gate insulating layer has a first region adjacent to the drain region and a second region adjacent to the source region, wherein an electron or hole density in the first region is higher than an electron or hole density in the second region.

6. The display device according to claim 3, wherein the second gate electrode is disposed to overlap a portion of the semiconductor layer other than the source region thereof.

7. The display device according to claim 6, wherein the first electrode of the third transistor is connected to the drain region, and the second electrode of the third transistor is connected to the source region.

8. The display device according to claim 6, wherein the first electrode of the third transistor is connected to the source region, and the second electrode of the third transistor is connected to the drain region.

9. The display device according to claim 6, wherein the third transistor further comprises a gate insulating layer disposed between the first gate electrode and the semiconductor layer, and wherein the gate insulating layer has a first region adjacent to the drain region and a second region adjacent to the source region, wherein an electron or hole density in the first region is higher than an electron or hole density in the second region.

10. The display device according to claim 1, wherein the third transistor comprises:

a first sub-transistor having a sub-gate electrode connected to the first scan line, a first electrode connected to the first node, and a second electrode; and a second sub-transistor having a sub-gate electrode connected to the first scan line, a first electrode connected to the second electrode of the first sub-transistor, and a second electrode connected to the third node.

11. The display device according to claim 10, wherein the sub-gate electrode of the first sub-transistor is separate from the first electrode and the second electrode of the first sub-transistor, and the sub-gate electrode of the second sub-transistor is separate from the first electrode and the second electrode of the second sub-transistor.

12. The display device according to claim 10, wherein one of the first sub-transistor and the second sub-transistor includes the second gate electrode.

13. The display device according to claim 12, wherein the first sub-transistor comprises a semiconductor layer disposed between the sub-gate electrode and the second gate electrode, the semiconductor layer includes a source region, a channel region, and a drain region, the second gate electrode is disposed to overlap at least a part of at least one of the source region, the channel region, and the drain region, the first sub-transistor further comprises a gate insulating layer between the sub-gate electrode and the semiconductor layer, wherein the gate insulating layer has a first region adjacent to the drain region and a second region adjacent to the source region, and wherein an electron or hole density in the first region is higher than an electron or hole density in the second region.

14. The display device according to claim 12, wherein the second gate electrode is disposed to overlap at least a part of the semiconductor layer other than the source region.

15. A display device comprising:

pixels, wherein each of the pixels comprises:

a first transistor having a gate electrode connected to a first node, a first electrode connected to a second node, and a second electrode connected to a third node;

a second transistor having a gate electrode connected to a first scan line, a first electrode connected to a data line, and a second electrode connected to the second node; and a third transistor having a first gate electrode connected to the first scan line, a second gate electrode, a first electrode connected to the first node, and a second electrode connected to the third node, wherein the third transistor comprises:

a first sub-transistor having a sub-gate electrode connected to the first scan line, a first electrode connected to the first node, and a second electrode; and a second sub-transistor having a sub-gate electrode connected to the first scan line, a first electrode connected to the second electrode of the first sub-transistor, and a second electrode connected to the third node, and at least one of the first sub-transistor and the second sub-transistor includes the second gate electrode.

16. The display device according to claim 15, wherein the second sub-transistor comprises a semiconductor layer disposed between the sub-gate electrode and the second gate electrode, the semiconductor layer includes a source region, a channel region, and a drain region, the second gate electrode overlaps at least a part of at least one of the source region, the channel region, and the drain region, and the second sub-transistor further comprises a gate insulating layer disposed between the sub-gate electrode and the semiconductor layer, wherein the gate insulating layer has a first region adjacent to the drain region and a second region adjacent to the source region, and an electron or hole density in the first region is higher than an electron or hole density in the second region.

17. The display device according to claim 15, wherein the second gate electrode is disposed to overlap a part of the semiconductor layer other than the source region.

18. The display device according to claim 10, wherein the first sub-transistor and the second sub-transistor comprise the second gate electrode.

19. The display device according to claim 1, wherein each of the pixels further comprises a light emitting diode, and the second gate electrode is connected to a cathode of the light emitting diode.

20. A method of aging a transistor comprising a first gate electrode, a second gate electrode, a semiconductor layer disposed between the first gate electrode and the second gate electrode, and including a source region doped with an acceptor, a channel region, and a drain region doped with an acceptor, and a gate insulating layer disposed between the first gate electrode and the semiconductor layer, the method comprising:

applying a voltage higher than a voltage of the drain region to the first gate electrode; and applying a voltage lower than the voltage of the first gate electrode to the second gate electrode such that electrons are trapped in a lattice of the gate insulating layer.

21. The method according to claim 20, wherein the second gate electrode overlaps at least a part of at least one of the source region, the channel region, and the drain region.

22. The method according to claim 20, wherein the second gate electrode overlaps at least a part of at least one of the drain region and the channel region.

23. A method of aging a transistor, comprising a first gate electrode, a second gate electrode, a semiconductor layer disposed between the first gate electrode and the second gate electrode, and including a source region doped with a donor, a channel region, and a drain region doped with a donor, and a gate insulating layer disposed between the first gate electrode and the semiconductor layer, the method comprising:

applying a voltage lower than a voltage of the drain region to the first gate electrode; and applying a voltage higher than the voltage of the first gate electrode to the second gate electrode such that holes are trapped in a lattice of the gate insulating layer.

24. The method according to claim 23, wherein the second gate electrode is disposed to overlap at least a part of at least one of the source region, the channel region, and the drain region.

25. The method according to claim 23, wherein the second gate electrode is disposed to overlap at least a part of at least one of the drain region and the channel region.

* * * * *